US008047422B2

(12) United States Patent
Tamamori et al.

(10) Patent No.: US 8,047,422 B2
(45) Date of Patent: Nov. 1, 2011

(54) METHOD FOR FABRICATING TRANSPORTATION PALLET

(75) Inventors: Chikao Tamamori, Ono (JP); Keitaro Yokogawa, Ono (JP); Nobuji Ota, Ono (JP)

(73) Assignee: Nakahara Co., Ltd., Ono-shi, Hyogo (JP)

( * ) Notice: Subject to any disclaimer, the term of this patent is extended or adjusted under 35 U.S.C. 154(b) by 633 days.

(21) Appl. No.: 11/664,700

(22) PCT Filed: Jun. 26, 2006

(86) PCT No.: PCT/JP2006/312733

§ 371 (c)(1),
(2), (4) Date: Apr. 5, 2007

(87) PCT Pub. No.: WO2007/148409

PCT Pub. Date: Dec. 27, 2007

(65) Prior Publication Data

US 2009/0049672 A1 Feb. 26, 2009

(30) Foreign Application Priority Data

Jun. 19, 2006 (JP) ..... 2006-169410

(51) Int. Cl.
*B23K 37/00* (2006.01)
*B23K 5/22* (2006.01)
*B65D 19/44* (2006.01)

(52) U.S. Cl. ..... 228/212; 228/4.1; 228/6.1; 108/51.11; 108/54.1; 108/55.3; 29/428

(58) Field of Classification Search ..... 228/4.1, 228/6.1, 212; 108/51.11, 54.1, 55.3; 29/428
See application file for complete search history.

(56) References Cited

U.S. PATENT DOCUMENTS

2003/0189153 A1* 10/2003 Nakabayashi et al. ... 248/346.02

FOREIGN PATENT DOCUMENTS

| | | | |
|---|---|---|---|
| JP | 7-13734 | U | 3/1995 |
| JP | 7-236993 | A | 9/1995 |
| JP | 9-156642 | A | 6/1997 |
| JP | 3097892 | U | 2/2004 |

(Continued)

OTHER PUBLICATIONS

Notification Concerning Availability of the publication of the International Application dated Dec. 27, 2007, International Application No. PCT/JP2006/312733.

(Continued)

*Primary Examiner* — Jessica L Ward
*Assistant Examiner* — Devang R Patel
(74) *Attorney, Agent, or Firm* — Westerman, Hattori, Daniels & Adrian, LLP

(57) ABSTRACT

This invention has an object to provide a method for precisely fabricating transportation pallets readily adaptable to model change and other alterations. In the method for fabricating a transportation pallet according to the invention, in which jig mounting plates are fixed on a steel pallet base, projecting pieces having holes to which jigs are attached are provided on one longer side of the jig mounting plates (12, 13) at a predetermined interval, a positioning member is secured on the pallet base, the jig mounting plates are temporarily secured along the positioning member, and the jig mounting plates are welded to be fixed on the pallet base.

2 Claims, 8 Drawing Sheets

FOREIGN PATENT DOCUMENTS

| | | | | |
|---|---|---|---|---|
| JP | 2005-253890 | A | | 9/2005 |
| JP | 2005253890 | A | * | 9/2005 |
| WO | WO 2007/148409 | A1 | | 12/2007 |

OTHER PUBLICATIONS

Notification of Transmittal of Translation of the International Preliminary Report on Patentability (Form PCT/IB/338) of International Application No. PCT/JP2006/312733 mailed Jan. 8, 2009 with Forms PCT/IB/373 and PCT/ISA/237.

Communication with Supplementary European Search Report dated Oct. 20, 2009 issued in corresponding European Patent Application No. 06767350.9.

International Search Report of PCT/JP2006/312733, date of mailing Aug. 29, 2006.

* cited by examiner

METHOD FOR FABRICATING TRANSPORTATION PALLET

BACKGROUND OF THE INVENTION

1. Field of the Invention

This invention relates to a method for fabricating transportation pallets, and for example, to a method for precisely fabricating a transportation pallet readily adaptable to model change or other alterations of various machine parts by changing the position of jigs so as to fit the machine parts.

2. Description of the Prior Art

Conventionally, transportation of various goods has been carried out with transportation pallets with components to be transported mounted thereon. Transportation pallets for general purpose use have difficulty in securely supporting and retaining the goods mounted thereon.

The transportation pallets are also used to transport parts of construction machines or the like mounted on the pallets. In the case where such parts are mounted on the general-purpose transportation pallet, the pallet cannot securely support the parts and also occasionally may damage the parts. To overcome the drawbacks, transportation pallets with jigs, which are suitable for each part, directly attached thereon are used.

However, the preparation of the transportation pallets fitting each part has a drawback in requiring much time and cost, because the transportation pallets need to be modified every time the parts are remodeled with changes of specification or for other reasons.

A transportation pallet capable of securely retaining various goods and readily adapting itself to the change in shape of the goods has been proposed (see Japanese unexamined patent publication No. 9-156642). This transportation pallet includes a substrate in which a large number of small holes for mounting jigs are made and projecting edges formed along the periphery of the substrate so as to stick out upward and downward, respectively. Several types of jigs for supporting transportation articles are arranged in predetermined positions on the upper surface of the substrate and detachably secured by bolts, which pass through the small holes, and nuts. The height of the jigs and the height of the securing bolts and nuts are set so as to be not higher than the height of the projecting edges.

For the transportation pallet disclosed in the above-mentioned Japanese unexamined patent publication No. 9-156642, the large number of small holes for mounting the jigs need to be formed in the substrate, which is a complicated work. In addition, in order to mount a heavy load on such a transportation pallet, the pallet should include a substrate of high strength in consideration of the necessary provision of the large number of small holes, which causes heavy weight and high cost of the pallet.

BRIEF SUMMARY OF THE INVENTION

In view of the circumstance, an object of the present invention is to provide a method for precisely fabricating a transportation pallet readily adaptable to model change and other alterations.

In a method for fabricating a transportation pallet with a steel pallet base and jig mounting plates fixed on the pallet base, the present invention is characterized by providing projecting pieces having holes for attaching jigs on one longer side of a jig mounting plate at a predetermined interval, securing a positioning member on the pallet base, temporarily securing the jig mounting plate along the positioning member, and welding the jig mounting plate to be fixed on the pallet base.

Preferably, after the shorter sides of the jig mounting plate are welded, a longer side that is not provided with the projecting pieces is welded, and subsequently, welding is performed between the projecting pieces.

In addition, the positioning member can include pin members to be inserted into the holes provided in the projecting pieces and a main positioning body to which the pin members are inserted.

Further, the positioning member can be a template provided with engaging cut portions for engaging the projecting pieces of the jig mounting plates. In addition, the engaging portions are provided on the projecting pieces of the jig mounting plates to engage with the engaging cut portions.

According to the above-mentioned structure, the jig mounting plates can be precisely positioned to be securely fixed on the steel pallet base.

DETAILED DESCRIPTION OF THE PREFERRED EMBODIMENTS

Detailed descriptions of embodiments of the present invention will be now made by referring to drawings. It should be noted that the same components or equivalent components are denoted with the same reference numbers and their descriptions are not reiterated to avoid repetition. FIG. 1 is a perspective view of a transportation pallet fabricated according to the fabrication method of the present invention. As shown in FIG. 1, this transportation pallet comprises a pair of longer-side pallet bases 10, 10 and a pair of shorter-side pallet bases 11, 11 fixed to the longer-side pallet bases 10, 10. The longer-side pallet bases 10, 10 are provided with cut-away portions 10*a* with which the shorter-side pallet bases 11 are engaged, and welded to fix with the shorter-side pallet bases 11, 11. The longer-side pallet bases 10 and shorter-side pallet bases 11 are, for example, lightweight channel steels with dimensions of 250 mm by 75 mm. The longer-side pallet bases 10 and shorter-side pallet bases 11 are laser-machined so as to have a length of 2800 mm and a length of 1100 mm, respectively. This lightweight channel steel may be a hot rolled steel plate for general structure (SS400), a cold rolled steel plate (SPC), a hot rolled steel plate (SPH) and so on. In this embodiment, the hot rolled steel plate for general structure (SS400) is used.

The pallet bases 10, 10 have recesses 10*b*, 10*b* and the pallet bases 11, 11 have recesses 11*b*, 11*b*, both for having blades of a forklift inserted therein.

Each of the longer-side pallet bases 10, 10 and the shorter-side pallet bases 11, 11 is fixedly welded with jig mounting plates 12 or 13 by a method which will be described later. A jig mounting plate 12 includes a support base 12*b* having four projecting pieces 12*a* on a longer side thereof. Each projection piece 12*a* has a hole 14 for attaching a jig. A jig mounting plate 13 includes a support base 13*b* having three projecting pieces 13*a* on a longer side thereof. Each projecting piece 13*a* has a hole 14 for attaching a jig. The jig mounting plates 12 and 13 have a different number of projecting pieces and therefore are different in length based on the number of the projecting pieces; however the dimension of the projecting piece, the interval between the projecting pieces and the width of the support base of the jig mounting plates 12 and 13 are the same.

These jig mounting plates 12, 13 are made from a hot rolled steel plate for general structure (SS400), cold rolled steel plate (SPC), hot rolled steel plate (SPH) or the like. In this embodiment, a hot rolled steel plate for general structure (SS400) is used to form the jig mounting plates 12, 13 into the predetermined shape by highly precise laser beam machining.

On the bottom of the pallet bases 10, 10, 11, 11, a bottom plate 15 is fixed to complete a transportation pallet.

FIG. 2 is a perspective view illustrating an example when a jig suitable for a component is attached to the jig mounting plates 12, 13 of the transportation pallet.

As show in FIG. 2, the holes 14 of the projecting pieces 12*a* (or 13*a*) of the jig mounting plates 12, 12 (or 13, 13) are aligned with holes 23 of attachment pieces 22 that are raised from a base 21 of a jig 20, and secured by bolts 30 and nuts 31. The base 21 is provided with a supporting shaft 25 for fitting and supporting a component. When the pallet carries remodeled components or different components, the things to do are to prepare the jigs 20 each having a supporting shaft 25 of the proper size for the respective components and to secure the jigs 20 to the predetermined holes 14 of the projecting pieces 12*a* (or 13*a*) of the jig mounting plates 12, 12 (or 13, 13).

However, attachment of the jig mounting plates 12, 12, 13, 13 in improper fixing positions on the pallet bases 10, 11 affects the assembly precision of the jig 20 with the holes 14 of the projecting piece 12*a* or 13*a*. This degraded assembly precision not only causes unstable retention of the components but also occasionally scratches the components. Therefore, the fixing position of the jig mounting plates 12, 12, 13, 13 should be properly determined to precisely attach the jig mounting plates 12, 12, 13, 13 on the pallet bases 10, 11.

This invention provides a method for properly determining the fixing positions of the jig mounting plates 12, 12, 13, 13 to attach them on the pallet bases 10, 11. The fixing positions of the jig mounting plates 12, 12 (13, 13) are set by properly determining four dimensions as will be described later. As mentioned above, the jig mounting plates 12, 12 (13, 13) are precisely dimensioned by laser machining. Therefore, the fixing positions of the jig mounting plates 12, 12 (13, 13) can be properly determined by properly aligning the dimensions of H1, P1, P2, W shown in FIG. 1 in order to attach the jig mounting plates 12, 12 (13, 13) to the fixing positions on the pallet bases 10, 11.

The four dimensions, as shown in FIG. 1, include a height (H1) of the pallet base 10 (11) to the hole 14 of the jig mounting plates 12, 12 (13, 13), pitches (P1) and (P2) each between the jig mounting plates 12 and 13, and a width (W) between the jig mounting plates 12 and 12 (or 13 and 13).

Highly-precise attachment of the jig mounting plates based on the above-mentioned dimensions is carried out with a setting jig to fabricate a pallet. The constraint conditions defined by the jig include the height (H1) of the jig mounting plates 12, 12 (13, 13). The pitches (P1), (P2) between the jig mounting plates 12 and 13 are constrained to the same pitches (P1), (P2) between holes, or to a prescribed dimension. The space between jig mounting plates 12, 12 (or 13, 13) is constrained to a constant dimension irrespective of the variation of the width of the lightweight channel steel of the pallet base.

With FIGS. 3 through 7, the fabricating method using the setting jig will be now described. FIG. 3 is a perspective view illustrating an example of how the setting jig 40 is used to attach the jig mounting plates 12, 12 (13, 13) to the longer-side pallet base 10. This setting jig 40 sets the pitches (P1), (P2) between the jig mounting plates 12 and 13 and the width (W) between the jig mounting plates 12 and 12 (or 13 and 13). The width W2 of the setting jig 40 is set to the width (W) between the jig mounting plates 12 and 12 (or 13 and 13). This setting jig 40 is positioned by an attachment member 45 and secured on the longer-side pallet base 10. As shown in FIG. 4, a position to be attached with a vertical jig 41 for setting the vertical position of the jig mounting plates 12, 12 (or 13, 13) is prescribed on the setting jig 40, and therefore the vertical jig 41 is attached to the prescribed position. The setting jig 40 is provided with an axial constraint pin 43 to be inserted into the holes 14 of the projecting pieces 12*a* (13*a*) to position the holes 14 in order to set the pitches (P1), (P2) between the jig mounting plates 12 and 13.

Height-setting jigs 42 for the jig mounting plates 12, 12 (or 13, 13) are placed under the jig 41 and near one end of the setting jig 40.

FIG. 5 is a perspective view illustrating an example of how a setting jig 50 is used to attach the jig mounting plates 13, 13 on the shorter-side pallet base 11. This setting jig 50 sets the position of the jig mounting plates 12 and 13, the width (W) between the jig mounting plates 13 and 13. The width of the setting jig 50 is set to the width between the jig mounting plates 13 and 13. This setting jig 50 is positioned by an attachment member 55 and secured on the shorter-side pallet base 11. A position to be attached with a vertical jig 51 for setting the vertical position of the jig mounting plates 13, 13 is prescribed on the setting jig 50, and therefore the vertical jig 51 is attached to the prescribed position. The setting jig 50 is provided with an axial constraint pin 53 to be inserted into the holes 14 of the projecting pieces 13*a* to position the holes 14 in order to set the position of the jig mounting plate 13.

Height-setting jigs 52 for the jig mounting plates 13, 13 are placed under the jig 51 and near one end of the setting jig 50.

FIG. 6 is a perspective view illustrating the state where the jig mounting plates 12, 12 (or 13, 13) is positioned after attachment of the setting jig 40 (or 50) on the pallet base 10 (or 11).

As shown in FIG. 6, the jig mounting plate 12, 12 (or 13, 13) is mounted on the jig 42 (or 52) so that the edge of the jig mounting plate 12, 12 (or 13, 13) abuts against the vertical jig 51 to set the vertical direction and height H1. Then, the axial constraint pin 53 is inserted into the hole 14 of the projecting piece 12*a* (or 13*a*) to determine the position of the jig mounting plate 12, 12 (or 13, 13), thereby completing the positioning of the jig mounting plate 12, 12 (or 13, 13) on the pallet base 10 (or 11). The jig mounting plate 12, 12 (or 13, 13) in this position is fixedly welded to the pallet base 10 (or 11).

In the fabricating method according to the present invention, welding order is also considered. As a result, it is found that the order of welding causes deformation, including distortion or the like, of the jig mounting plates 12, 12 (or 13, 13). To avoid the deformation, as shown in FIG. 7, the jig mounting plate 12 (13) is welded from its shorter side in the present invention. In this embodiment, part A is welded first, and subsequently part B is welded. After that, the longer side (part C in FIG. 7) that is not provided with the projecting pieces 12*a* (13*a*) is welded. At last, the spaces between the projecting pieces 12*a* (13*a*) (part Ds in FIG. 7) are welded. By welding in this order, the jig mounting plates 12, 12 (or 13, 13) can be fixed without deformation.

In this embodiment, arc welding is adopted. Arc welding is performed under the following conditions. The welding current system is operated at a rated output current of 350 A (200 A for single phase), a rated input voltage of 200 V for three-phase and 220 V for single phase. The rated input is 18 kVA/15.2 kW; the output welding current range is from 100 A to 250 A; and the output crater current range is in 125 A. The rated load voltage is 36 V. The output welding voltage range is from 14 V to 38 V and the output crater voltage is from 14 V to 38 V. The rated duty cycle is 60%. The diameter of applicable wires is 0.9 mm, but 1.0 mm or 1.2 mm is also available.

The wire feeder uses wires having a diameter of 0.9 mm, however, 1.0 mm or 1.2 mm is also available. The cable length is 0.35 m.

The welding torch is operated at a rated current of 350 A, a rated duty cycle of 40% (carbon dioxide)) and 20% (MAG). The diameter of applicable wires is 0.9 mm, but 1.0 mm or 1.2 mm is also available. The cable length is 3 m. The welding torch is an air-cooled type and curved in shape. The maximum gas flow rate is 10 liters to 20 liters/min.

Next description will be about another embodiment of the present invention. FIG. 8 is a perspective view illustrating another embodiment of the invention, while FIG. 9 is a perspective view illustrating the relevant part of the embodiment of the invention. In this embodiment, a laser processed template is used as a setting jig 60. In the setting jig 60, cuts 61 for engaging the projecting pieces 12*a* (or 13*a*) of the jig mounting plates 12, 12 (or 13, 13) are formed by laser processing. This setting jig 60 serving as a template is precisely formed by laser processing. In addition, the projecting piece 12*a* (or 13*a*) is provided with engaging portions 12*f* (13*f*) for engaging the cuts 61. The engaging portions 12*f* (13*f*) are also precisely formed by laser processing.

The above-mentioned setting jig 60 is located at a prescribed position on the pallet base 10 (or 11) and then secured by bolts 62. Subsequently, the engaging portions 12*f* (13*f*) are engaged with the cuts 61 to locate the jig mounting plates 12, 12 (or 13, 13) at the prescribed position on the pallet base 10 (or 11). After thus being located, the jig mounting plates 12, 12 (or 13, 13) are welded in the same order as mentioned above to be fixed on the pallet base 10 (or 11).

It should be understood that the embodiments disclosed herein are to be taken as examples and are not limited. The scope of the present invention is defined not by the above described embodiments but by the following claims. All changes that fall within meets and bounds of the claims, or equivalence of such meets and bounds are intended to be embraced by the claims.

Figure 1:
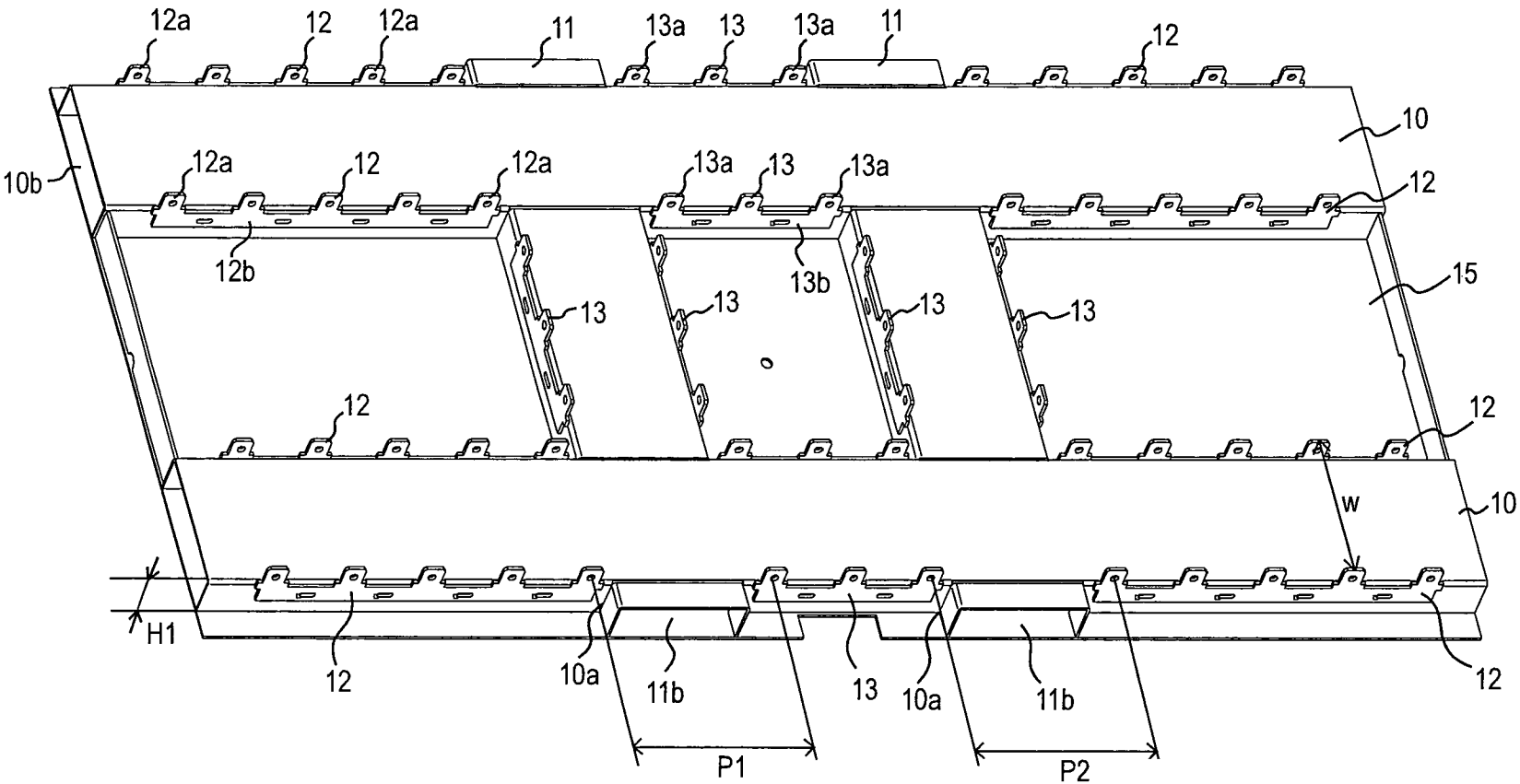
FIG. 1 is a perspective view of a transportation pallet fabricated according to the fabrication method of the present invention.
Figure 2:
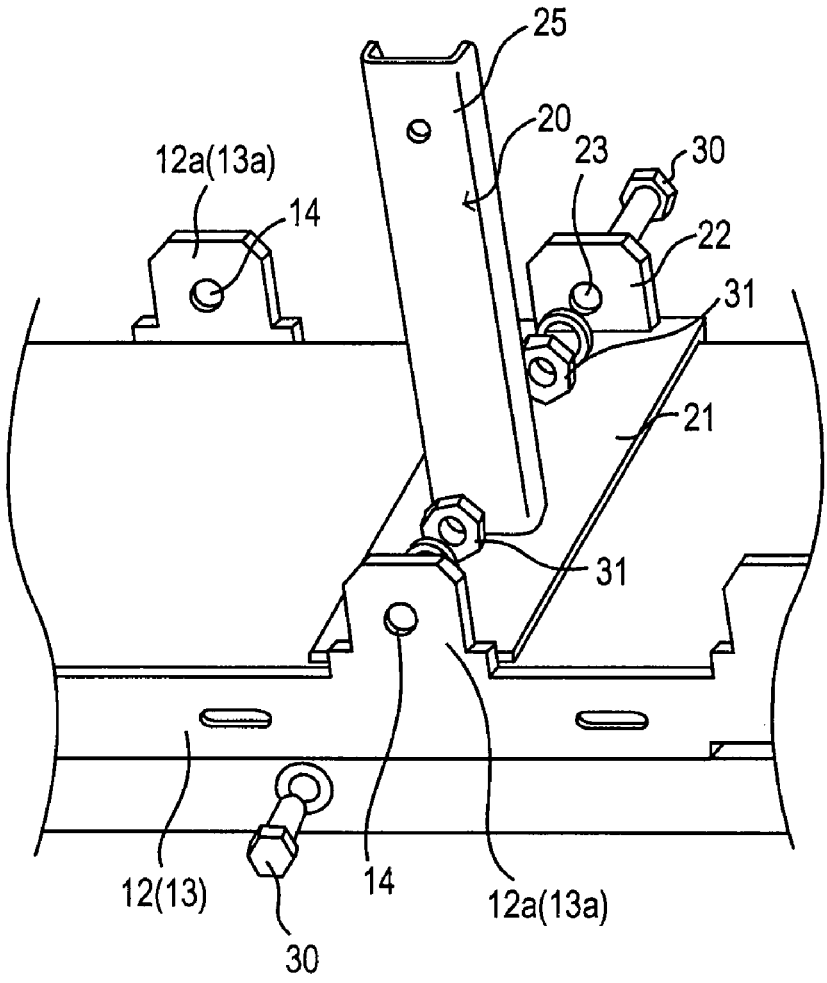
FIG. 2 is a perspective view illustrating an example when a jig suitable for a component is attached to the jig mounting plates of the transportation pallet.
Figure 3:
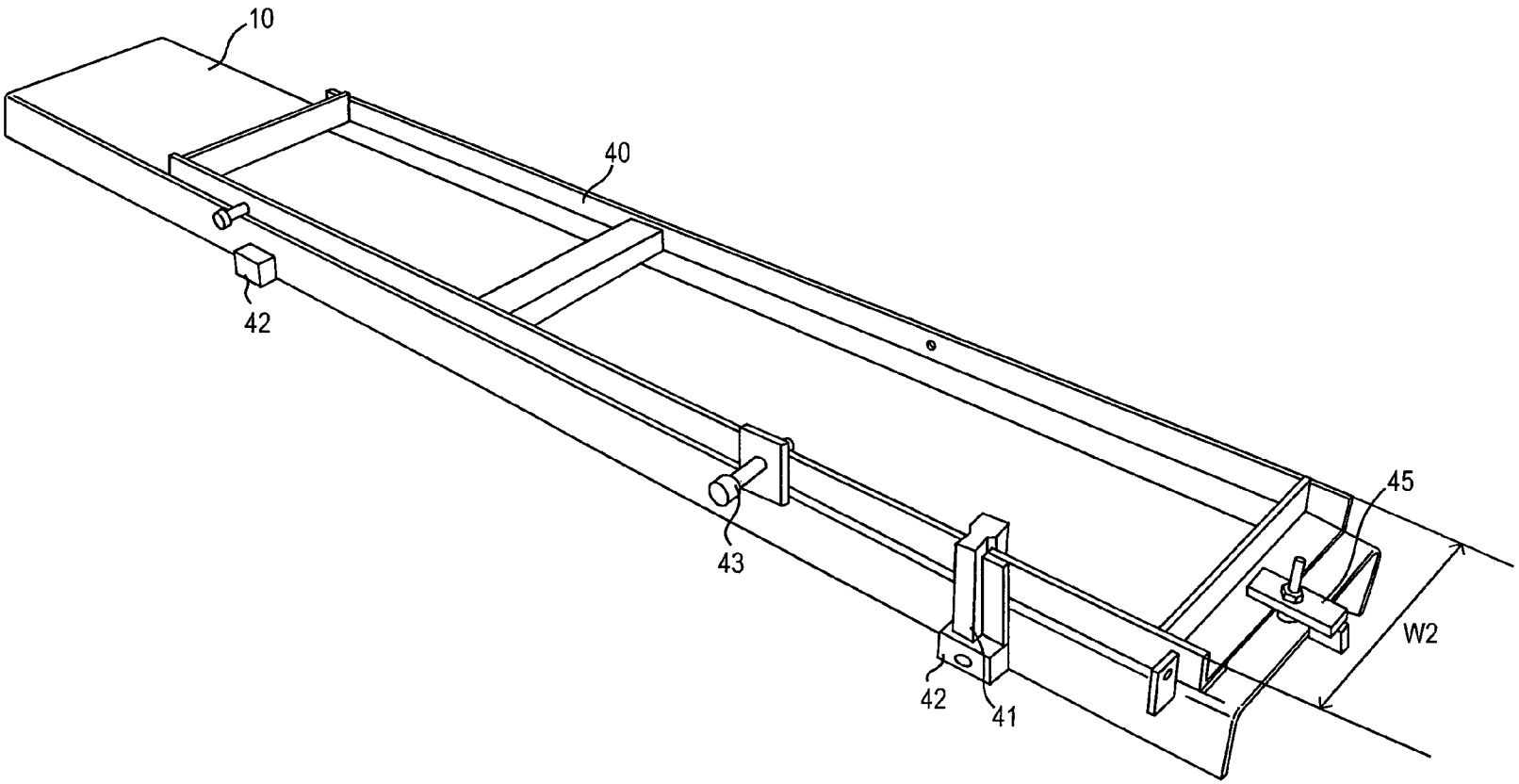
FIG. 3 is a perspective view illustrating an example of how a setting jig is used to attach the jig mounting plates to the longer-side pallet base.
Figure 4:
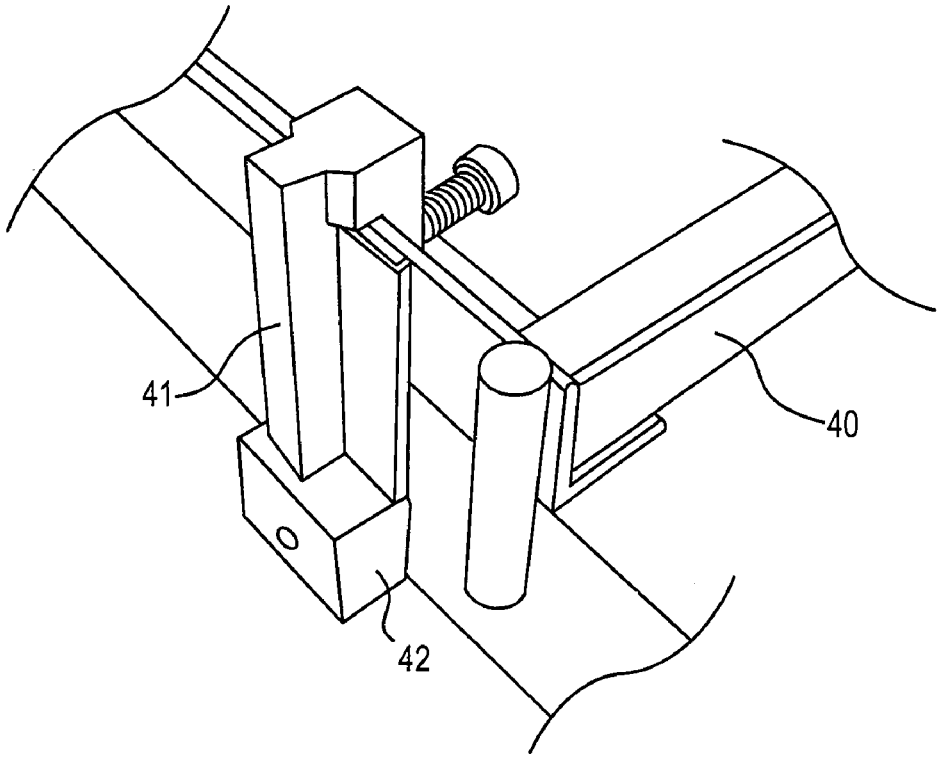
FIG. 4 is a perspective view of a vertical setting jig in an attached state.
Figure 5:
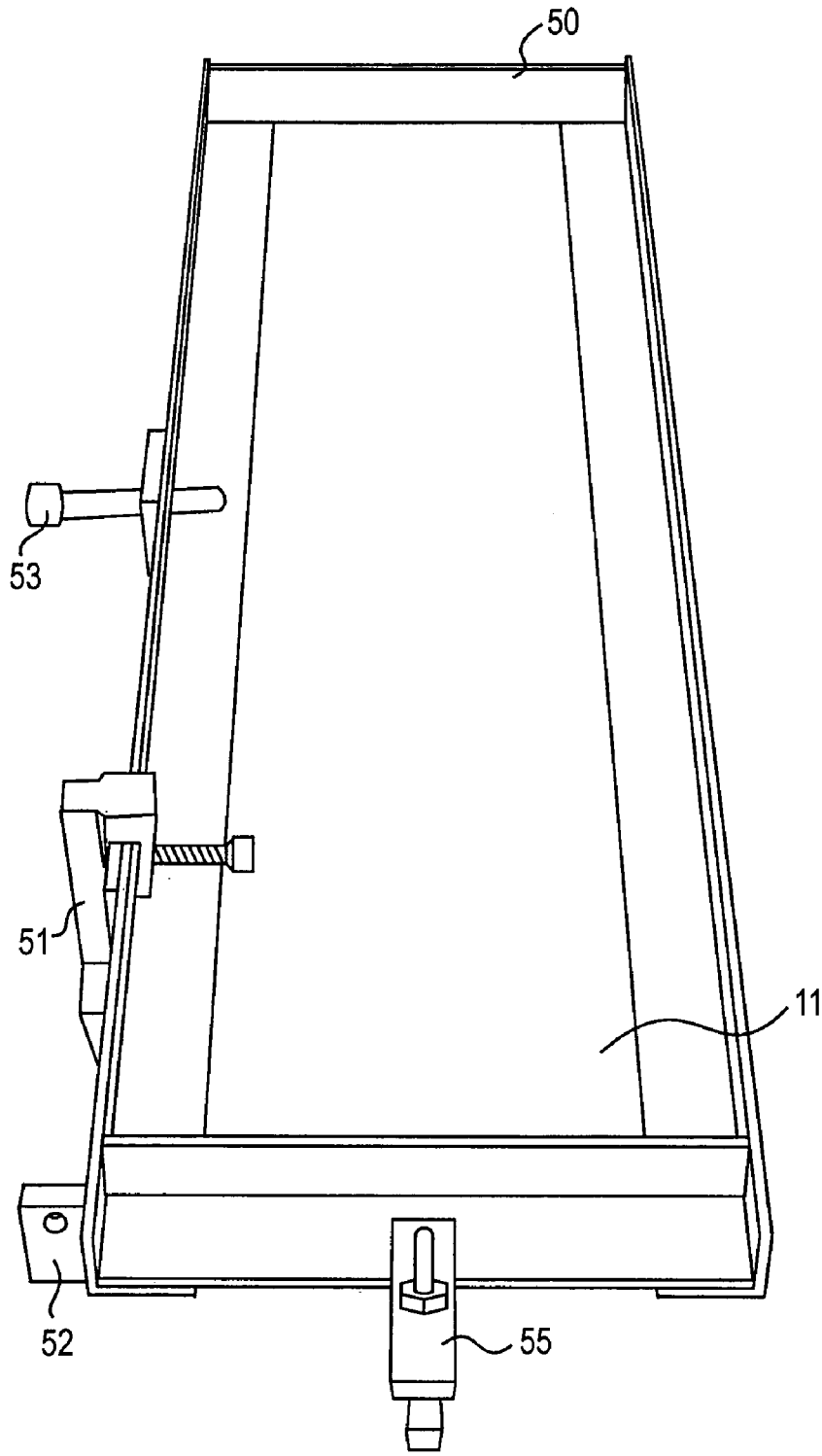
FIG. 5 is a perspective view illustrating an example of how the setting jig is used to attach the jig mounting plates to the shorter-side pallet base.
Figure 6:
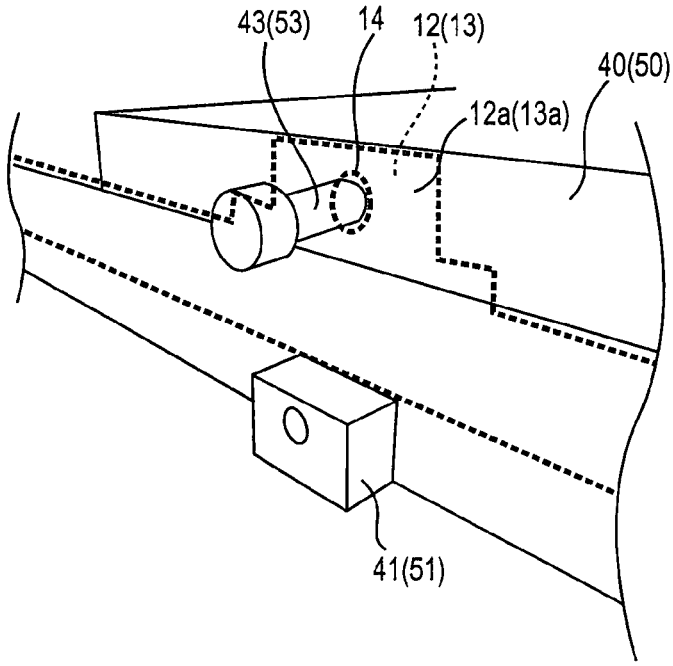
FIG. 6 is a perspective view illustrating the state where the jig mounting plate is positioned after attachment of the setting jig on the pallet base.
Figure 7:
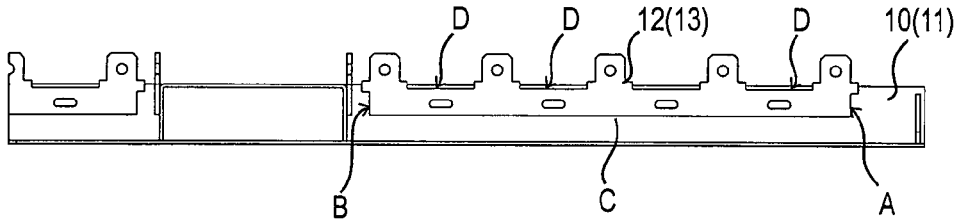
FIG. 7 is a front view showing the order of welding the jig mounting plate.
Figure 8:
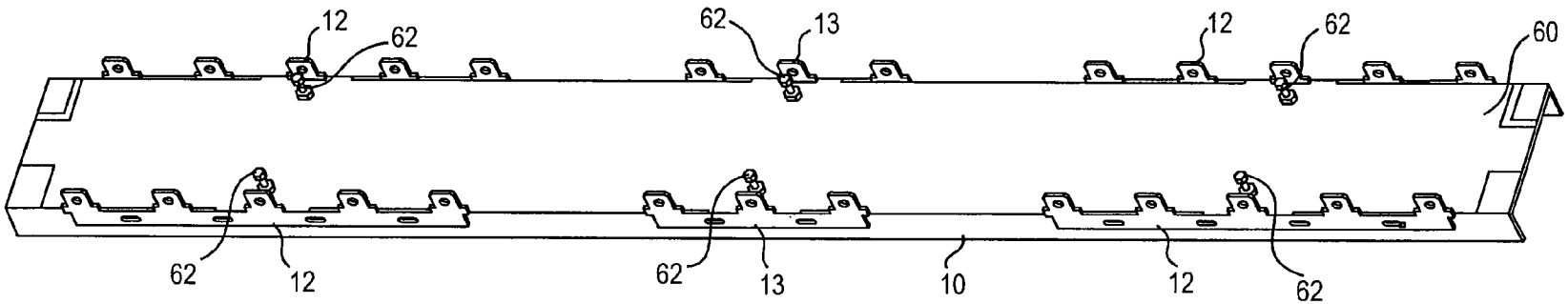
FIG. 8 is a perspective view of another embodiment of the invention.
Figure 9:
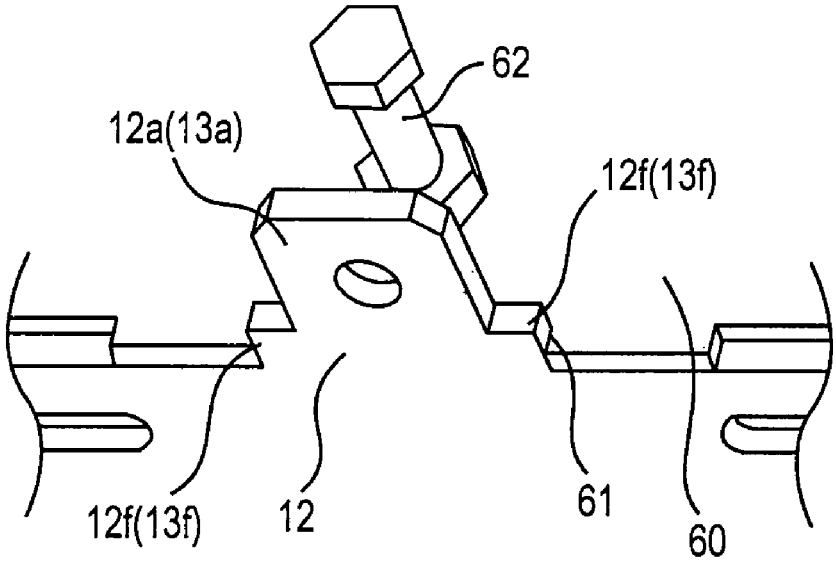
FIG. 9 is a perspective view illustrating a relevant part of another embodiment of the invention.

What is claimed is:

1. A method for fabricating a transportation pallet with a steel pallet base and jig mounting plates fixed on the pallet base, said method comprising the steps of:

providing projecting pieces on one longer side of each of first and second jig mounting plates at a predetermined interval, said projecting pieces having holes for attaching jigs;

securing a positioning member on said pallet base;

positioning said first and second jig mounting plates against said positioning member;

using said positioning member to set a pitch between said first and second jig mounting plates, a width between said first and second jig mounting plates, and a height of said pallet base to said holes of projecting pieces such that said pitch, width and height determines a first fixing position for said first jig mounting plate and a second fixing position for said second jig mounting plate on said pallet base;

temporarily securing said first and second jig mounting plates to said positioning member; and welding said first and second jig mounting plates at said first and second fixing positions, respectively on said pallet base after said first and second jig mounting plates are temporarily secured to said positioning member, wherein said positioning member includes pin members to be inserted into the holes provided in said projecting pieces and a main positioning body to which said pin members are inserted.

2. The method for fabricating a transportation pallet according to claim 1, wherein after shorter sides of said jig mounting plate are welded, a longer side that is not provided with said projecting pieces is welded, and subsequently, welding is performed between said projecting pieces.

* * * * *